US008042808B2

(12) United States Patent
Sato

(10) Patent No.: US 8,042,808 B2
(45) Date of Patent: Oct. 25, 2011

(54) IMAGE FORMING SYSTEM AND PAPER SHEET OUTPUT METHOD

(75) Inventor: Ryuichi Sato, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 70 days.

(21) Appl. No.: 12/556,132

(22) Filed: Sep. 9, 2009

(65) Prior Publication Data

US 2010/0244359 A1 Sep. 30, 2010

(30) Foreign Application Priority Data

Mar. 25, 2009 (JP) ..... 2009-075112

(51) Int. Cl.
*B65H 39/10* (2006.01)

(52) U.S. Cl. ..... 271/298; 271/288; 271/289; 270/58.03; 270/52.14; 270/58.15; 270/52.16

(58) Field of Classification Search ..... 271/298, 271/288, 289, 302; 270/58.03, 52.14, 52.15, 270/52.16; 399/18, 21, 403
See application file for complete search history.

(56) References Cited

U.S. PATENT DOCUMENTS 5,272,511 A * 12/1993 Conrad et al. ..... 399/382
7,017,903 B2 * 3/2006 Fujii et al. ..... 271/298
7,140,611 B2 * 11/2006 Fujii et al. ..... 271/298
7,396,012 B2 * 7/2008 Bobrow ..... 271/185
7,770,890 B2 * 8/2010 Ohnishi et al. ..... 271/298

FOREIGN PATENT DOCUMENTS

JP 09-258516 10/1997
JP 10-129889 5/1998

* cited by examiner

*Primary Examiner* — Stefanos Karmis
*Assistant Examiner* — Luis A Gonzalez
(74) *Attorney, Agent, or Firm* — Morgan, Lewis & Bockius LLP

(57) ABSTRACT

The image forming system includes: a first transporting unit transporting paper sheets along a first transportation route; an image forming unit forming images on the paper sheets; a sheet supplying unit having a second transportation route, and transporting a sheet along the second transportation route to supply the sheet to a gap between the paper sheets sequentially transported along the first transportation route, the second transportation route joining the first transportation route at a position located on a downstream of the image forming unit in a transportation direction; and a controller outputting, to respective first and second output units, a paper sheet located on a downstream of the gap, and a paper sheet located on an upstream of the gap while causing the image forming unit to form an image on the paper sheet on the upstream of the image forming unit, when the sheet is not supplied.

8 Claims, 7 Drawing Sheets

IMAGE FORMING SYSTEM AND PAPER SHEET OUTPUT METHOD

CROSS REFERENCE TO RELATED APPLICATIONS

This application is based on and claims priority under 35 USC §119 from Japanese Patent Application No. 2009-75112 filed Mar. 25, 2009.

BACKGROUND

1. Technical Field

The present invention relates to an image forming system forming an image on a paper sheet, and a paper sheet output method.

2. Related Art

There has been proposed a technique in which recording papers left in a transportation route upon occurrence of jamming are tried to be reused.

SUMMARY

According to an aspect of the present invention, there is provided an image forming system including: a first transporting unit that transports paper sheets along a first transportation route; an image forming unit that forms images on the paper sheets transported by the first transporting unit; a sheet supplying unit that has a second transportation route, and transports a sheet along the second transportation route to supply the sheet to a gap between the paper sheets sequentially transported along the first transportation route, the second transportation route joining the first transportation route at a position located on a downstream of the image forming unit in a paper sheet transporting direction; and a controller that output, to a first output unit, a paper sheet located on a downstream of the gap between the paper sheets in the paper sheet transporting direction and outputs, to a second output unit different from the first output unit, a paper sheet located on an upstream of the gap between the paper sheets in the paper sheet transporting direction while causing the image forming unit to form an image on the paper sheet located on the upstream of the image forming unit, when the sheet is not supplied from the sheet supplying unit to the gap between the paper sheets.

BRIEF DESCRIPTION OF THE DRAWINGS

Exemplary embodiment(s) of the present invention will be described in detail based on the following figures, wherein.

DETAILED DESCRIPTION

An exemplary embodiment of the present invention will be described below in detail with reference to the accompanying drawings.

Figure 1:
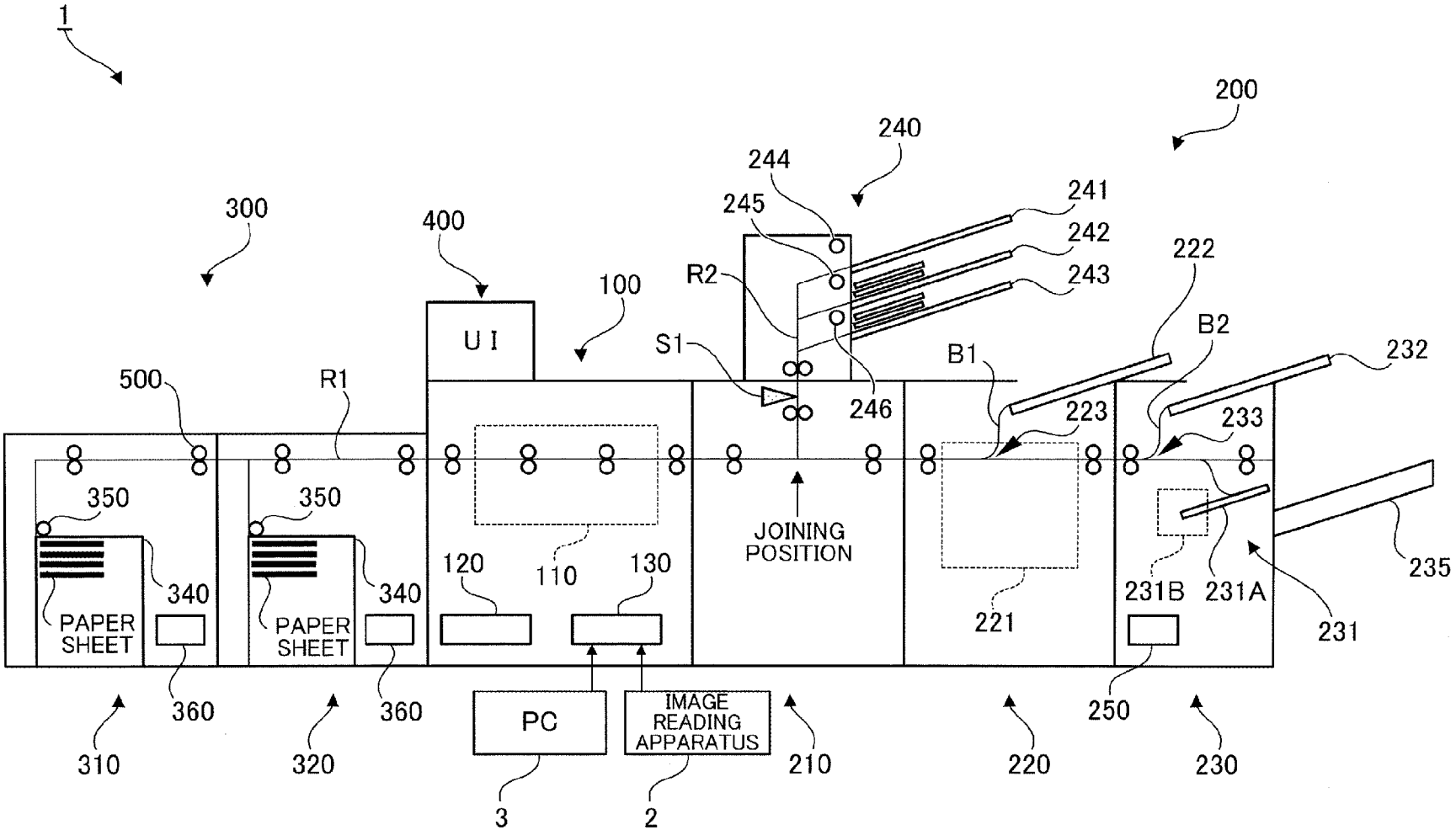
FIG. 1 is a view showing a configuration of an image forming system to which the exemplary embodiment is applied.

FIG. 1 is a view showing a configuration of an image forming system to which the exemplary embodiment is applied.

The image forming system 1 to which the present exemplary embodiment is applied includes: an image forming apparatus 100 that forms an image on a paper sheet; a paper sheet processing apparatus 200 that applies processing set in advance, to a paper sheet on which an image has been formed by the image forming apparatus 100; and a paper sheet supplying apparatus 300 that supplies paper sheets to the image forming apparatus 100.

The image forming system 1 also includes a user interface (UI) 400 that is composed of a display panel, that receiving information from a user and that displays information to a user. Note that this UI 400, which functions as a part of a receiving unit, is provided in the image forming apparatus 100. Additionally, a first transportation route R1 is provided from the paper sheet supplying apparatus 300 to the paper sheet processing apparatus 200 in the image forming system 1. The image forming system 1 also includes plural transportation rolls 500 that are provided along this first transportation route R1, a second transportation route R2 and the like, and that transport paper sheets, front covers and the like. The second transportation route R2 and the front covers will be described later. Here, the transportation rolls 500 that transport paper sheets along the first transportation route R1 are taken as a first transporting unit.

The image forming apparatus 100 includes an image forming unit 110, an overall controller 120, and an image processing unit 130. The image forming unit 110 forms an image on a paper sheet. The overall controller 120 controls units and devices in the image forming apparatus 100. Additionally, the overall controller 120 controls the paper sheet supplying apparatus 300 through a paper sheet supply controller 360 provided in the paper sheet supplying apparatus 300, and controls the paper sheet processing apparatus 200 through a paper sheet processing controller 250 provided in the paper sheet processing apparatus 200. The image processing unit 130 is connected to an image reading apparatus 2 and a personal computer (PC) 3, and applies image processing to image data received therefrom. Note that image data to which image processing has been applied by the image processing unit 130 is outputted to the image forming unit 110.

Here, the image forming unit 110 is capable of forming an image on a paper sheet, for example, by use of an electrophotographic manner. In this electrophotographic manner, a toner image is formed on an image carrier, such as a photoconductive drum or an intermediate transfer body, after charging, exposing and developing processes. Then, the toner image is transferred onto a paper sheet by a transfer device, and then fixed on the paper sheet by a fixing device.

The paper sheet processing apparatus 200 is formed of plural units (modules). To be more specific, the paper sheet processing apparatus 200 includes a transportation unit 210, a folding unit 220, a finisher 230, an interposer 240 and the paper sheet processing controller 250. The transportation unit 210 further transports a paper sheet transported from the image forming apparatus 100 to the downstream side. The folding unit 220 applies a letter fold (C-folding) or an accordion fold (Z-folding) to the paper sheet transported thereto from the transportation unit 210. The finisher 230 applies final processing to the paper sheet having passed through this folding unit 220. The interposer 240 supplies a front cover, a back cover, inserted paper sheets and the like which are used in forming a book-form copy. The paper sheet processing controller 250 controls units and portions provided in the paper sheet processing apparatus 200. Note that the paper sheet processing controller 250 is provided in the finisher 230 in the present exemplary embodiment. However, the paper sheet processing controller 250 may be provided in another unit.

Here, the folding unit 220 has a folding function unit 221 that applies a letter fold (C-folding) or an accordion fold (Z-folding) to a paper sheet. In the folding unit 220, a first branch transportation route B1 is provided. The first branch transportation route B1 is branched off from the first transportation route R1. In addition, the folding unit 220 includes a first paper sheet stacking unit 222, a gate 223, and a drive source (not shown in the figure). The first paper sheet stacking unit 222 (one example of a second output unit) stacks thereon paper sheets transported thereto via the first branch transportation route B1. The gate 223 is used for switching a transportation destination of a paper sheet to any one of the first transportation route R1 and the first branch transportation route B1. The drive source such as a solenoid drives the gate 223.

The finisher 230 is provided with a stapling function unit 231 that applies stapling processing to paper sheets. Additionally, a center-binding bookmaking function unit that makes a book by center-binding a bundle of paper sheets, a punching function unit that applies hole opening (punching) of two holes or four holes, and the like are provided in the finisher 230 although illustrations thereof are omitted. In the finisher 230, a second branch transportation route B2 is provided. The second branch transportation route B2 is branched off from the first transportation route R1. In addition, the finisher 230 is provided with a second paper sheet stacking unit 232, a gate 233, a drive source (not shown in the figure), and a third paper sheet stacking unit 235. The second paper sheet stacking unit 232 stacks thereon paper sheets transported thereto via the second branch transportation route B2. The gate 233 is used for switching a transportation destination of a paper sheet to any one of the first transportation route R1 and the second branch transportation route B2. The drive source such as a solenoid drives the gate 233. The third paper sheet stacking unit 235 (one example of the first output unit) stacks thereon paper sheets transported thereto via the first transportation route R1 and paper sheets (a paper sheet bundle) to which stapling processing has been applied by the stapling function unit 231.

Here, a detailed description is given of the stapling function unit 231. The stapling function unit 231 includes a compile tray 231A and a stapling head 231B. The compile tray 231A allows paper sheets to be accumulated thereon, the paper sheets transported thereto via the first transportation route R1 to form one paper sheet bundle. The stapling head 231B performs stapling processing on the paper sheet bundle placed on the compile tray 231A. Additionally, an output roll that outputs, to the third paper sheet stacking unit 235, paper sheets on which stapling processing has been performed by the stapling head 231B is provided in the stapling function unit 231, although an illustration thereof is omitted.

The interposer 240 that functions as one example of a sheet supplying unit includes plural sheet supplying units on which front covers, back covers, inserted sheets and the like, which are examples of sheets, are stacked. More specifically, the interposer 240 according to the present exemplary embodiment includes three sheet supplying units which are a first sheet supplying unit 241, a second sheet supplying unit 242 and a third sheet supplying unit 243. Note that, in the present exemplary embodiment, the front covers are stacked on the second sheet supplying unit 242, whereas the back covers are stacked on the third sheet supplying unit 243. Meanwhile, on the first sheet supplying unit 241, any sheets such as front covers are not stacked.

Additionally, the interposer 240 includes a first feeding roll 244 (one example of a first feeding unit), a second feeding roll 245 (one example of a second feeding unit) and a third feeding roll 246 that are provided so as to correspond to the first to third sheet supplying units 241 to 243, respectively, and feed the front covers or the like which are stacked on the first to third sheet supplying units 241 to 243, respectively. Additionally, the interposer 240 includes size detecting sensors (not shown in the figure) that are provided so as to correspond to the first to third sheet supplying units 241 to 243, respectively, and detect sizes of the front covers and the like which are stacked on the first to third sheet supplying units 241 to 243, respectively.

Here, the front covers and the like fed by the respective first to third feeding rolls 244 to 246 are fed into the first transportation route R1 via the second transportation route R2 which is provided inside the interposer 240 and the transportation unit 210. In an additional remark, a joining position (a joining portion) where the front covers and the like coming out from the interposer 240 join the first transportation route R1 is provided inside the transportation unit 210. Note that, a sensor that detects that the plural front covers and the like are overlapped with each other in a case the overlapped front covers and the like are transported thereto from the interposer 240, is provided in the transportation unit 210 although the description thereof has been omitted above. More specifically, a multi-feed detecting sensor S1 that detects a multi feed of the front covers and the like is provided in the transportation unit 210.

Meanwhile, the paper sheet supplying apparatus 300 that functions as a paper sheet supplying unit includes: a first paper sheet supplying device 310 arranged on the upstream side in a paper sheet transporting direction; and a second paper sheet supplying device 320 arranged on the relatively downstream side in the paper sheet transporting direction.

Here, the first paper sheet supplying device 310 and the second paper sheet supplying device 320 are configured in the same manner. Each of the first and second paper sheet supplying devices 310 and 320 includes: a paper sheet containing portion 340 that contains paper sheets therein; and a feeding roll 350 that feeds, into the first transportation route R1, paper sheets having been contained in this paper sheet containing portion 340. Each of the first and second paper sheet supplying devices 310 and 320 also includes the paper sheet supply controller 360.

Here, a processing flow for producing a book-form copy by this image forming system 1 will be described.

For example, in a case where a book-form copy which has a front cover and to which the stapling processing is applied is produced, image formation is firstly performed by the image forming apparatus 100 on paper sheets sequentially transferred thereto. More specifically, toner images are firstly formed on the respective image carriers such as the photoconductive drums and the intermediate transfer body after charging, exposing and developing processes. Then, these toner images are transferred onto each of the paper sheets by a transfer device. Thereafter, these toner images are fixed on each of the paper sheets by a fixing device.

Subsequently, the paper sheets on which images have been formed are accumulated on the compile tray 231A in the stapling function unit 231 after passing through the transportation unit 210 and the folding unit 220. Note that, the front cover has been supplied to the compile tray 231A from the interposer 240 before the paper sheets are accumulated on the compile tray 231A. After the required number of paper sheets has been accumulated on the compile tray 231A, the staple processing is performed by the stapling head 231B. Thereafter, the paper sheets (a book-form copy) to which the stapling processing has been applied are outputted to the third paper sheet stacking unit 235.

Incidentally, in a case where the above book-form copies are produced, production efficiency for the book-form copies is decreased if paper sheets for the next book-form copy are supplied from the paper sheet supplying apparatus 300 after the completion of one book-form copy. Thus, paper sheets are transported in a manner as shown in FIG. 2, for example, to improve production efficiency of the book-form copies.

Figure 2:
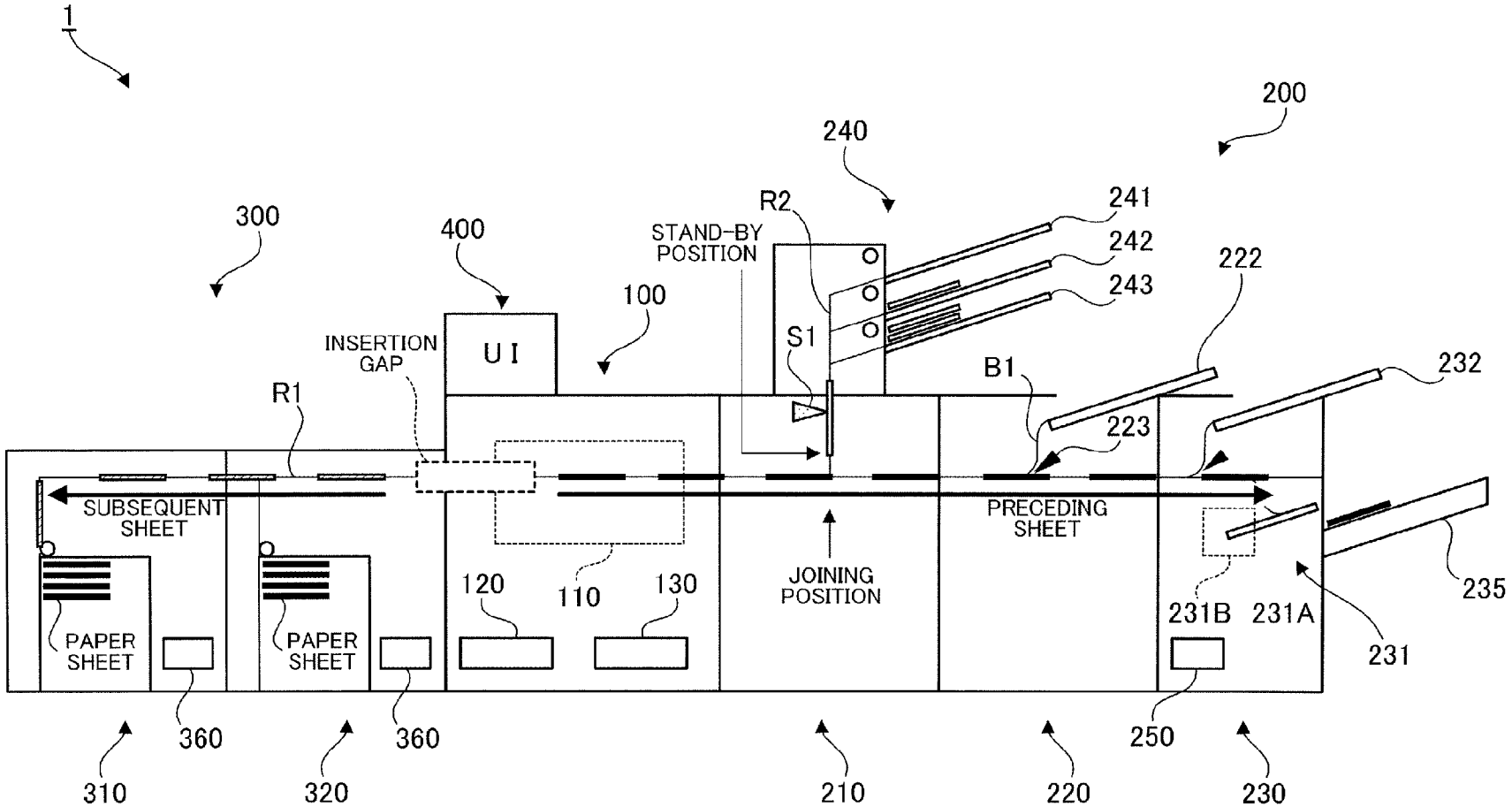
FIG. 2 is a view for explaining one example of a paper sheet transporting configuration.

Here, FIG. 2 is a view for explaining one example of a paper sheet transporting configuration. Note that, in this view, an illustration of the transportation rolls 500 is omitted for better viewing. Note that, in the paper sheet transporting configuration shown in this figure, paper sheets (hereinafter, referred to as "preceding sheets" in some cases) being transported for one of the book-form copies are followed by paper sheets for another one of the book-form copies, and the paper sheets for another one of the book-form copies are transported. That is, while the preceding sheets exist inside the image forming system 1, the paper sheets used for another one of the book-form copies are transported. Note that the paper sheets for another one of the book-form copies may be referred to as "subsequent sheets" in some cases hereinafter.

Here, a gap corresponding to a size of the front cover is provided between the preceding sheet and the subsequent sheet, so that a front cover supplied from the interposer 240 may be inserted therebetween. In an additional remark, the subsequent sheet is transported with a gap for one piece of the front cover. Note that, this gap may be referred to as an "insertion gap" hereinafter.

In the paper sheet transporting configuration shown in this view, the front cover has already been supplied from the interposer 240, and this front cover is standing by at a standby position set in advance, which is located on the upstream of the joining position. Then, once the insertion gap reaches the joining position, the front cover is inserted in this insertion gap. In a case where such a paper sheet transporting configuration is employed, productivity for book-form copies is enhanced as compared to an aspect in which new paper sheets are supplied after the completion of producing one of the book-form copies.

Incidentally, when the front covers are supplied from the interposer 240, the multi feed or jamming (a paper sheet jam or a sheet jam) may occur in some cases. In this case, the front cover is not allowed to be supplied to the insertion gap. As a result, a problematic situation where the front cover is not supplied for the subsequent sheets is brought about. In other words, one of the book-form copies to be formed from the subsequent sheets lacks the front cover.

Even when the multi feed or jamming occurs as described above, production of a book-form copy, for example, by use of the preceding sheets is continuable since the front cover has already been supplied thereto. On the other hand, the subsequent sheets to which the front cover is not allowed to be supplied may be outputted to, for example, the first paper sheet stacking unit 222 without image formation. In this case, the subsequent sheets stacked on the first paper sheet stacking unit 222 become reusable by being reset in, for example, the paper sheet supplying apparatus 300. However, since the subsequent sheets may possibly contain a paper sheet on which an image has already been formed, paper sheets not having images formed thereon should be sorted from the paper sheet stacked on the first paper sheet stacking unit 222 so that some of the subsequent sheets are reused. Incidentally, this sorting is troublesome, and paper sheets are often discarded without being reused.

For this reason, the image forming system 1 in the present exemplary embodiment executes the following processing.

Figure 3:
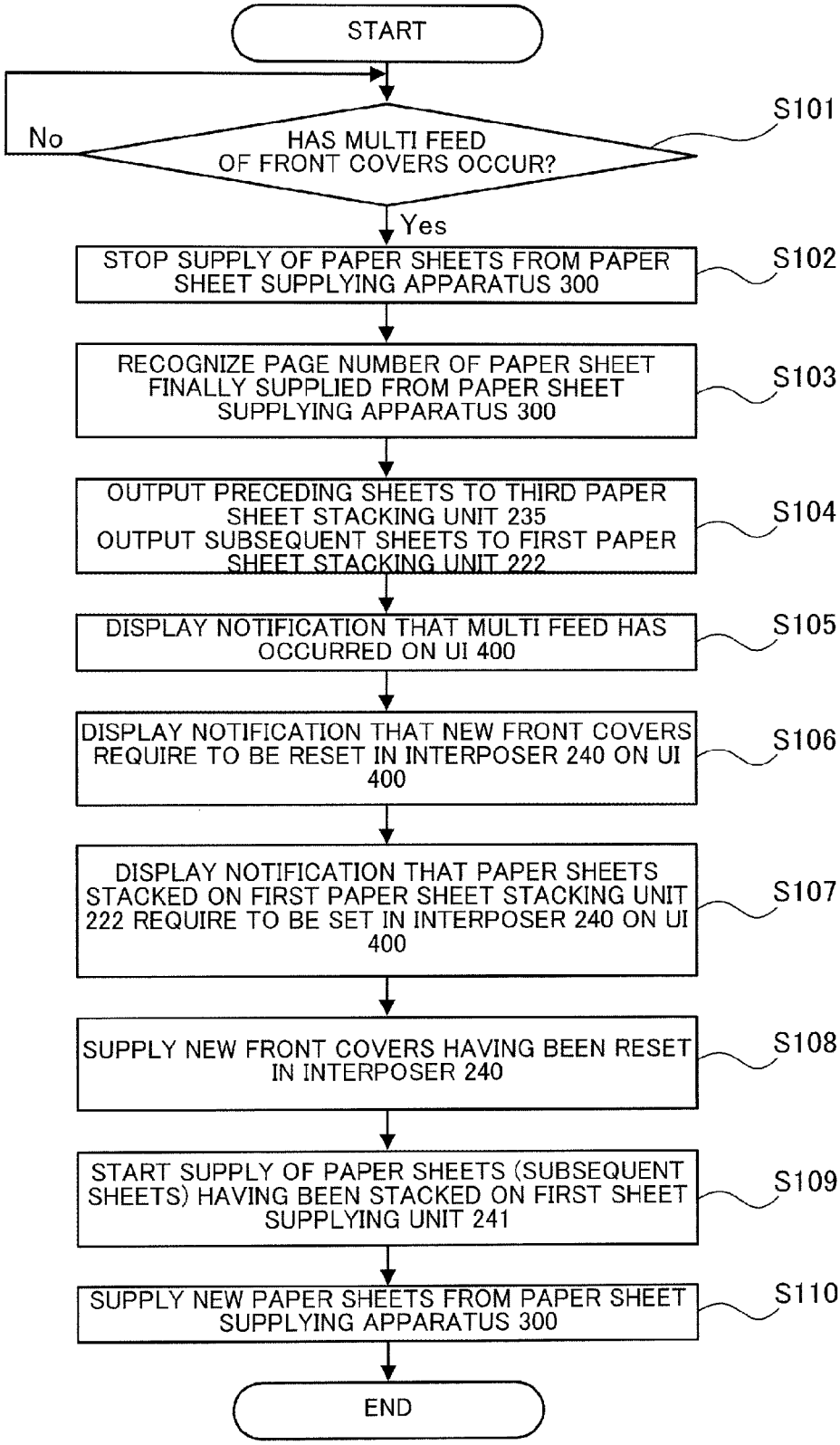
FIG. 3 is a flowchart showing a flow of processing executed by the overall controller.

FIG. 3 is a flowchart showing a flow of processing executed by the overall controller 120. The flow of this processing will be sequentially described below with reference to FIGS. 4A, 4B, 5A, and 5B (views for explaining the processing executed by the overall controller 120). Here, this processing exemplifies a case where front covers are supplied from the interposer 240. Additionally, the following processing is realized when central processing unit (CPU) provided in the overall controller 120 causes a program from an external memory device, such as a hard disk, to be read into a main memory. Here, the program is provided for realizing the following processing.

The overall controller 120, having started transportation of paper sheets and transportation of the front covers, judges whether or not the multi feed of the front covers has occurred (step 101). Specifically, on the basis of an output from the multi-feed detecting sensor S1, the overall controller 120 judges whether or not the multi feed of the front covers supplied from the interposer 240 has occurred. Then, when having judged that the multi feed (refer to FIG. 4A) has occurred, the overall controller 120 stops supply of the paper sheets from the paper sheet supplying apparatus 300 (step 102). Note that this stopping of the supply is performed through the paper sheet supply controller 360. Additionally, the overall controller 120 recognizes a page number of a paper sheet lastly supplied from the paper sheet supplying apparatus 300 (step 103). Note that, in the present exemplary embodiment, the overall controller 120 does not stop the operation of the image forming unit 110, but causes the image forming unit 110 to keep operating. Thereby, images are formed not only on preceding sheet but also on subsequent sheet.

Thereafter, the overall controller 120 outputs the preceding sheets to the third paper sheet stacking unit 235 provided in the finisher 230, and outputs the subsequent sheets to the first paper sheet stacking unit 222 provided in the folding unit 220 (step 104). Specifically, through the paper sheet processing controller 250, the overall controller 120 outputs the preceding sheets to the third paper sheet stacking unit 235 and outputs the subsequent sheets to the first paper sheet stacking unit 222. More specifically, the overall controller 120 temporarily accumulates the preceding sheets on the compile tray 231A in the stapling function unit 231. Thereafter, the overall controller 120 executes stapling processing thereon, and outputs the preceding sheets to the third paper sheet stacking unit 235. Additionally, after the last paper sheet in the preceding sheets passes the gate 223, the overall controller 120 switches transportation destinations by driving this gate 223, thereby causing the subsequent sheets to pass through the first branch transportation route B1 and then be outputted to the first paper sheet stacking unit 222.

Figure 4A:
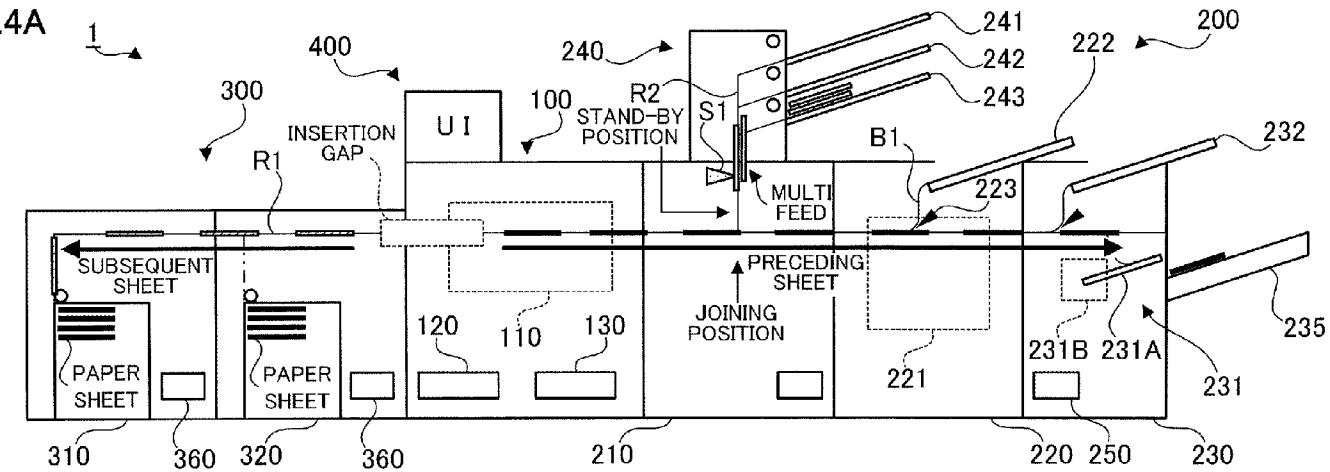
FIGS. 4A and 4B are views for explaining the processing executed by the overall controller.
Figure 4B:
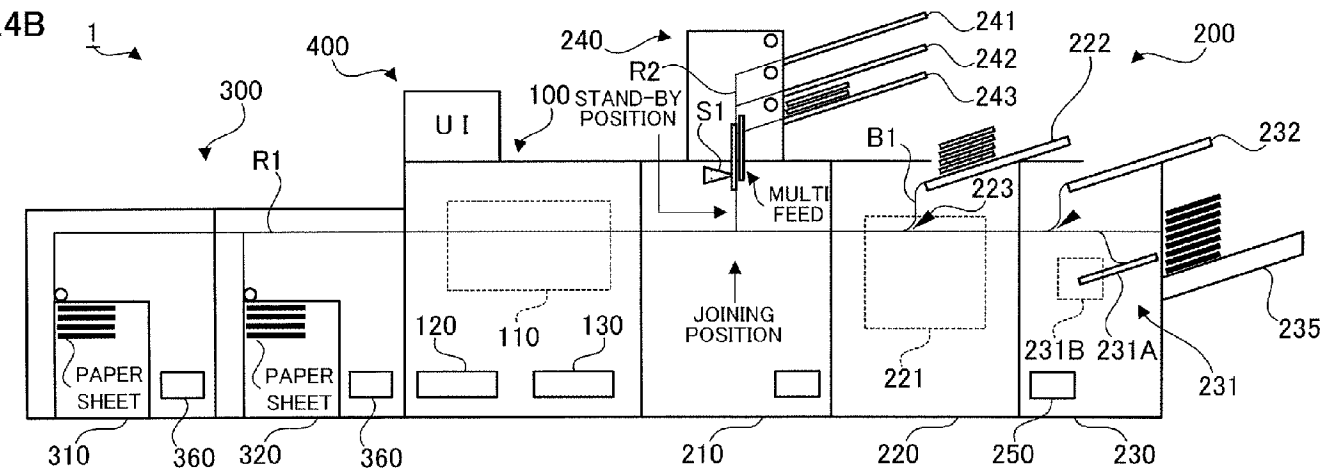

By the above processing, as shown in FIG. 4B, a book-form copy having a front cover is stacked on the third paper sheet stacking unit 235, the book-form copy being formed of the preceding sheets. On the other hand, subsequent sheets on which images have been respectively formed are stacked on the first paper sheet stacking unit 222.

Subsequently, the overall controller 120 displays, on the UI 400, a notification that the multi feed has occurred (step 105), thereby notifying a user that the multi feed has occurred.

Additionally, the overall controller 120 displays, on the UI 400, a notification that new front covers substituting for front covers having been overlapped with each other require to be reset in the interposer 240 (more specifically, on the second sheet supplying unit 242 of the interposer 240) (step 106). Furthermore, the overall controller 120 displays, on the UI 400, a notification that paper sheets (the subsequent sheets) stacked on the first paper sheet stacking unit 222 require to be set in the interposer 240 (step 107). More specifically, the overall controller 120 displays, on the UI 400, a notification that the paper sheets require to be set on the first sheet supplying unit 241 in the interposer 240.

Figure 5A:
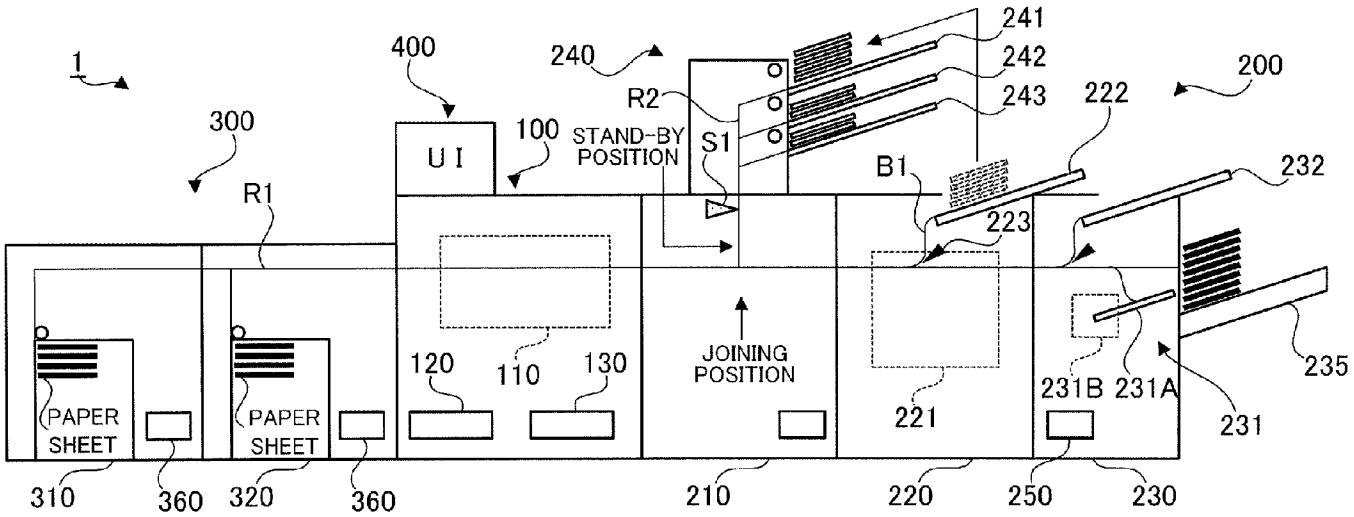
FIGS. 5A and 5B are views for explaining the processing executed by the overall controller.

Thereby, as shown in FIG. 5A, the front covers having been overlapped with each other are removed. Additionally, new front covers are set on the second sheet supplying unit 242 of the interposer 240. Furthermore, the paper sheets (subsequent sheets) having been stacked on the first paper sheet stacking unit 222 are stacked on the first sheet supplying unit 241 in the interposer 240. Note that, in this processing, a description is given of an example in which the paper sheets (subsequent sheets) having been stacked on the first paper sheet stacking unit 222 are stacked on the first sheet supplying unit 241 of the interposer 240. However, the user may be allowed to select a stacking destination of the paper sheets (subsequent sheets). Additionally, instead of being determined in a single uniform manner, a stacking destination of the paper sheets may be determined on the basis of a result of detection of a vacant sheet supplying unit (a sheet supplying unit on which any sheets such as front covers are not stacked) by a sensor not shown in the figure.

Subsequently, when the user presses a start button not shown in the figure, the overall controller 120 supplies the new front covers having been reset in the interposer 240 (step 108). Thereafter, the overall controller 120 starts supply (transportation) of the paper sheets (the subsequent sheets) having been stacked on the first sheet supplying unit 241 in the interposer 240 (step 109). Then, the overall controller 120 supplies new paper sheets from the paper sheet supplying apparatus 300 (step 110), the new paper sheets following the paper sheets (the subsequent sheets) having been supplied from the first sheet supplying unit 241 in the interposer 240.

Figure 5B:
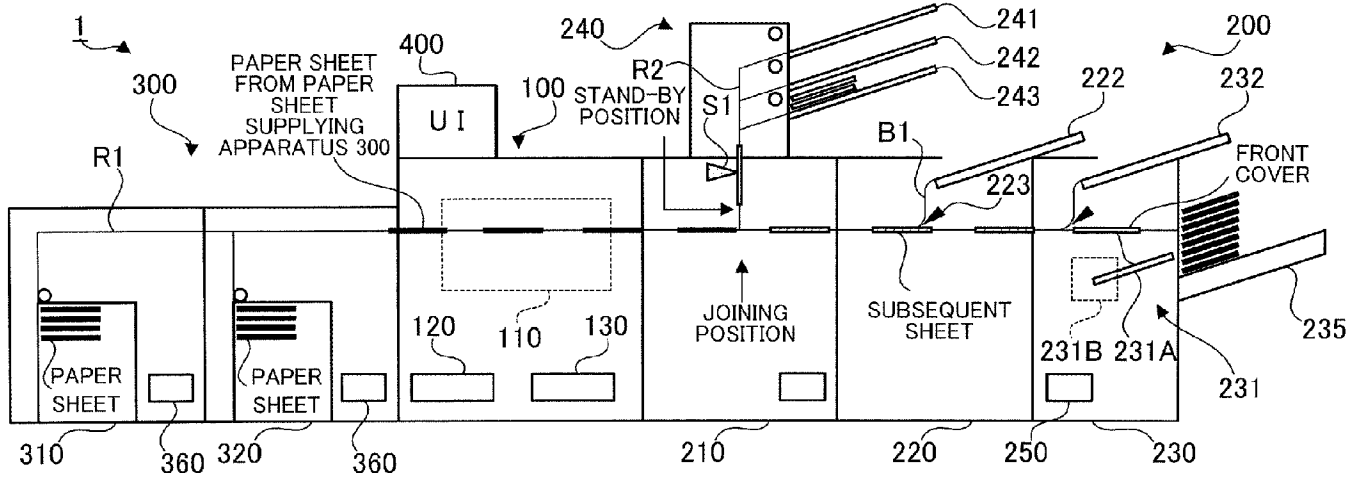

By the above processing, as shown in FIG. 5B, one of the front covers is positioned at the head of a line of paper sheets, and is followed by the paper sheets (subsequent sheets) supplied from the interposer 240. Additionally, the paper sheets (subsequent sheets) supplied from the interposer 240 are followed by paper sheets supplied from the paper sheet supplying apparatus 300.

Note that, when forming images in the image forming unit 110 on the respective paper sheets supplied from the paper sheet supplying apparatus 300, the overall controller 120 forms images corresponding to pages having page numbers following the page number recognized in the above step on the paper sheets supplied from the paper sheet supplying apparatus 300. For example, if the page number recognized in the above step 103 is N, images corresponding to pages of page numbers (N+1) and higher are sequentially formed on the respective paper sheets supplied from the paper sheet supplying apparatus 300.

Note that, although the processing performed upon occurrence of the multi feed has been described above, the same processing may be performed upon occurrence of jamming (a paper sheet jam or a sheet jam). For example, in a case where the front cover has not been detected within a time period set in advance by a sensor (not shown in the figure) provided on the second transportation route R2, it may be judged that jamming has occurred, and the same processing as above may be performed. Additionally, in a case where the front covers are not allowed to be supplied from the interposer 240 because no front covers exist in the interposer 240, the same processing as above may be also performed.

Additionally, in the above processing, the subsequent sheets are outputted to the first paper sheet stacking unit 222 in the folding unit 220, but otherwise, may be outputted to the second paper sheet stacking unit 232 in the finisher 230.

Additionally, although in the above processing, the description has been given of an example in which the subsequent sheets on which images have been formed are set in the interposer 240, the subsequent sheets may be set at a location other than the interposer 240. However, in order to prevent the subsequent sheets from passing through the image forming unit 110 again, it is necessary that the subsequent sheets should be set at a location connected to a transportation route that joins the first transportation route R1 at a position located downstream of the image forming unit 110 in the paper sheet transporting direction.

In the above processing, upon occurrence of the multi feed of front covers supplied from the interposer 240, subsequent sheets are outputted after images are formed thereon. However, processing in which subsequent sheets are outputted without image formation may be alternatively executed through a selection by a user. That is, processing may be selectable between a first mode in which the subsequent sheets are outputted after images are formed thereon, and a second mode in which the subsequent sheets are outputted without image formation. Note that this selection of a mode may be performed through the UI 400, and the overall controller 120 executes different processing in accordance with a mode selected through the UI 400.

Additionally, in a case where the interposer 240 is attachable to and detachable from the image forming system 1, processing may be automatically set to the first mode when the interposer 240 is attached, and may be automatically set to the second mode when the interposer 240 is not attached. In an additional remark, processing may be automatically set to the first mode when a unit (the interposer 240 here) on which subsequent sheets are resettable is attached, and may be automatically set to the second mode when a unit on which subsequent sheets are resettable is not attached.

Here, the above description has been given by taking, as an example, the case where the front covers are supplied from the interposer 240. Incidentally, when plural book-form copies, each having a front cover and a back cover and being subjected to the staple processing, are produced, there may possibly occur a case where back covers are overlapped with each other. In this case, preceding sheets are outputted to the compile tray 231A in the stapling function unit 231. Additionally, subsequent sheets are outputted to the first paper sheet stacking unit 222 as in the above described case.

Then, the subsequent sheets are to be supplied from the interposer 240 as in the above-described case. Before the supply of the subsequent sheets, a back cover used for the preceding sheets is supplied in this case. Thereby, the back cover is supplied to the compile tray 231A in the stapling function unit 231, and thus the staple processing is executed. Accordingly, a book-form copy formed of the preceding sheets is completed.

Then, after the back cover has been supplied, a front cover used for the subsequent sheets is supplied successively, and then the subsequent sheets are supplied. Additionally, paper sheets are supplied from the paper sheet supplying apparatus 300 as in the above-described case. Then, a back cover is supplied from the interposer 240 so as to follow the final paper sheet of the paper sheets supplied from the paper sheet supplying apparatus 300.

Thereby, the front cover, the subsequent sheets, the paper sheets supplied from the paper sheet supplying apparatus 300 and the back cover supplied from the interposer 240 are accumulated on the compile tray 231A in the stapling function unit 231. Thereafter, the stapling processing is executed. Thereby, the formation of a book-form copy containing the subsequent sheets is completed.

Additionally, for example, in a case where a inserted sheet to be inserted between paper sheets are supplied from the interposer 240, upon occurrence of the multi feed of the inserted sheets, preceding sheets, which precede an insertion gap (an insertion position) into which the inserted sheet is inserted, is outputted to the compile tray 231A in the stapling function unit 231. Meanwhile, the subsequent sheets following the insertion gap are outputted to the first paper sheet stacking unit 222.

Then, the subsequent sheets are to be supplied from the interposer 240 as in the above described case. Before the supply of the subsequent sheets, the inserted sheet is supplied from the interposer 240 in this case. Thereby, the inserted sheet is supplied to the compile tray 231A in the stapling function unit 231. Then, the subsequent sheets are supplied successively after the inserted sheet is supplied. Additionally, paper sheets are supplied from the paper sheet supplying apparatus 300 as in the above described case. Thereby, the preceding sheets, the inserted sheet, the subsequent sheets, and the paper sheets supplied from the paper sheet supplying apparatus 300 are accumulated on the compile tray 231A in the stapling function unit 231. Thereafter, the stapling processing is executed, whereby the formation of a book-form copy into which the inserted sheet is inserted is completed.

Note that, the description has been given above of the processing in a case where the multi feed or jamming of the front covers or the like supplied from the interposer 240 occurs. However, the above processing is also applicable to the case where jamming occurs in the first transportation route R1, for example.

FIGS. 6A, 6B, 7A and 7B are views for explaining processing executed upon occurrence of jamming in the first transportation route R1. Note that, the following description will be given by taking, as an example, processing executed when jamming occurs in the folding unit 220 (refer to FIG. 6A).

Figure 6A:
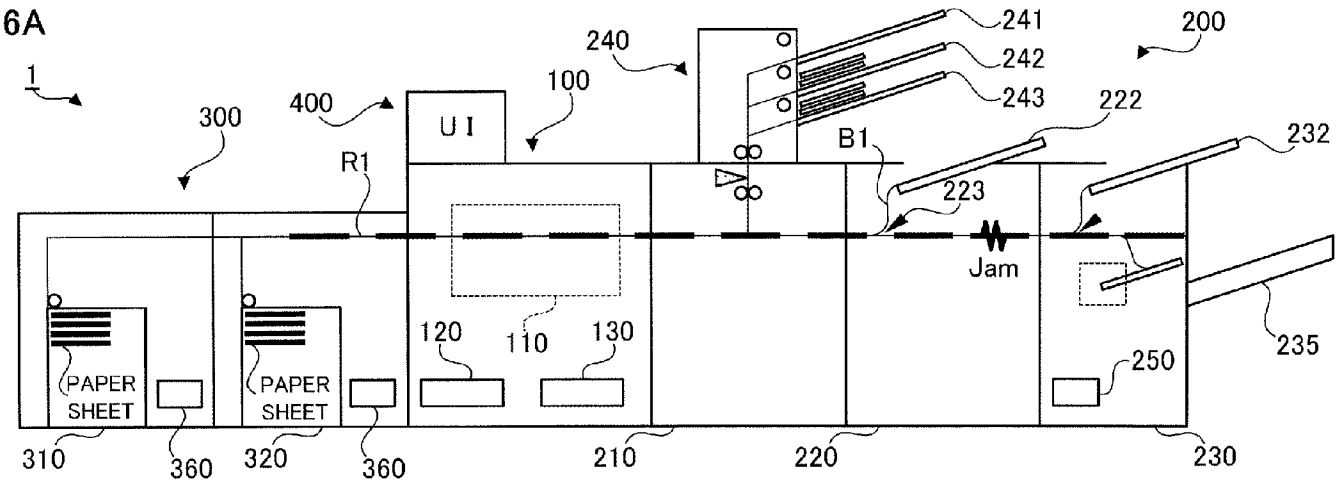
FIGS. 6A and 6B are views for explaining processing executed upon occurrence of jamming in the first transportation route.
Figure 6B:
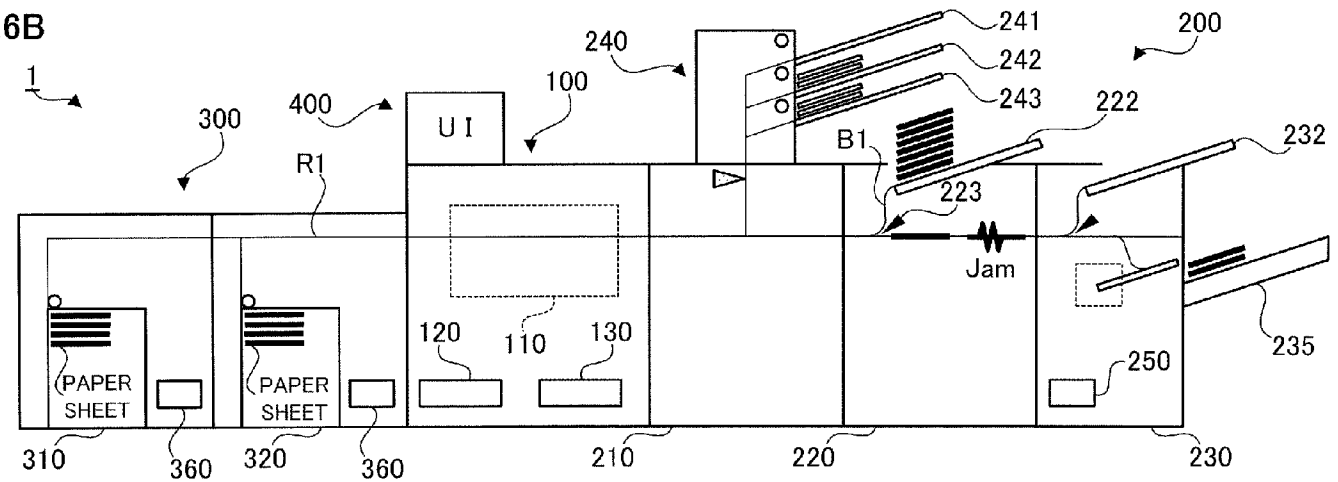

As shown in FIG. 6A, when jamming occurs in the folding unit 220, paper sheets that are allowed to be normally output and that are located on the downstream of a location where the jam has occurred, in the paper sheet transporting direction, are outputted to the third paper sheet stacking unit 235. Note that, in this example, paper sheets located in the finisher 230 are outputted to the third paper sheet stacking unit 235 as shown in FIG. 6B.

Additionally, a paper sheet (hereinafter, referred to as a "jammed sheet") that has been jammed, and a paper sheet that follows the jammed sheet and that is not allowed to be outputted to the first paper sheet stacking unit 222, are kept being stopped inside the folding unit 220 as they are. Specifically, a jammed sheet, and a paper sheet that follows the jammed sheet and that is located on the downstream of a connecting portion of the first transportation route R1 and the first branch transportation route B1, in the paper sheet transporting direction, are kept being stopped inside the folding unit 220 (refer to FIG. 6B).

Meanwhile, paper sheets that follow the jammed sheet and that are allowed to be outputted to the first paper sheet stacking unit 222 (paper sheets located on the upstream of the connecting portion in the paper sheet transporting direction) are outputted to the first paper sheet stacking unit 222. Note that, at this time, images are formed in the image forming unit 110 on paper sheets on which images have not been formed (paper sheets located on the upstream of the image forming unit 110 in the paper sheet transporting direction). As a result, paper sheets on which images have been formed are stacked on the first paper sheet stacking unit 222 as shown in FIG. 6B.

Figure 7A:
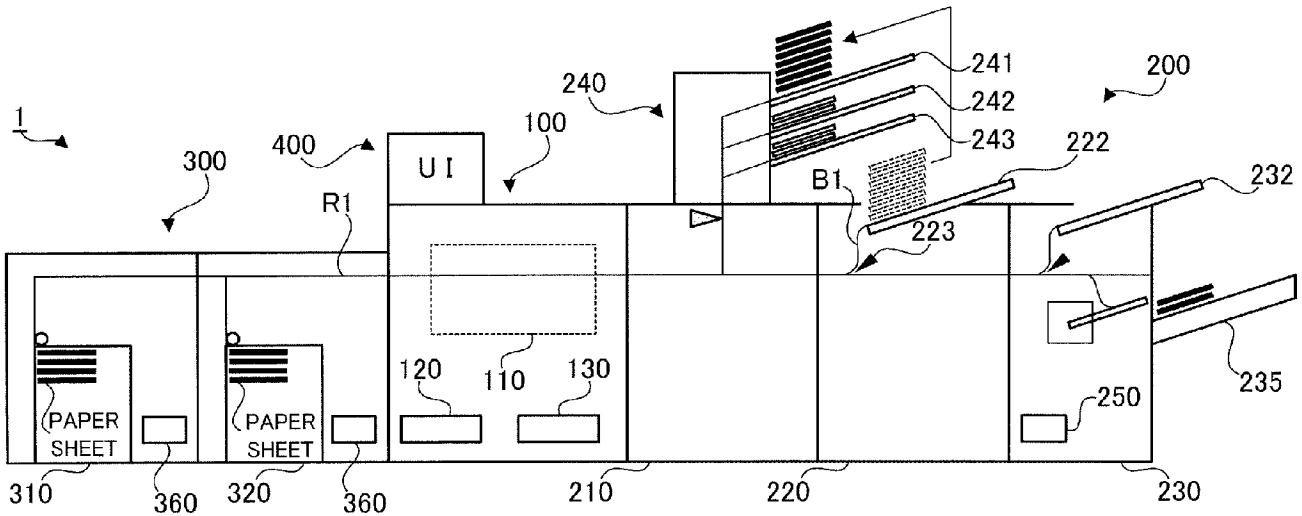
FIGS. 7A and 7B are views for explaining processing executed upon occurrence of jamming in the first transportation route.

Subsequently, as in the above described case, a notification that removal of the jammed sheet is required is displayed on the UI 400. Additionally, as in the above described case, a notification that paper sheets stacked on the first paper sheet stacking unit 222 require to be set in the interposer 240 is displayed on the UI 400. With the display of those notifications on the UI 400, as shown in FIG. 7A, the paper sheets stacked on the first paper sheet stacking unit 222 are set on the first sheet supplying unit 241 in the interposer 240, and the jammed sheet in the folding unit 220 is removed.

Figure 7B:
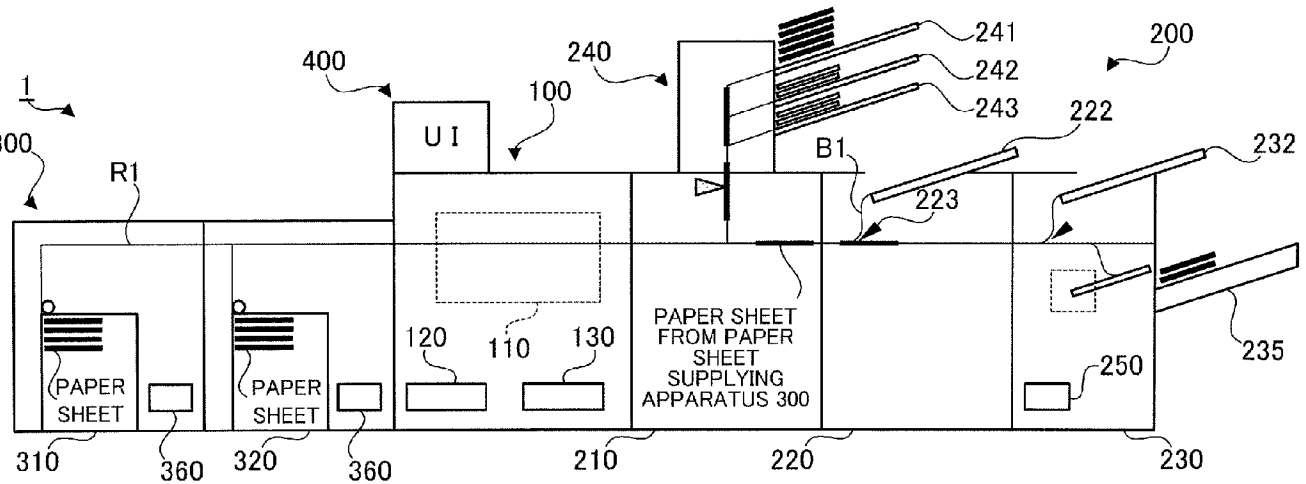

Thereafter, when the user presses the start button (not shown in the figure), paper sheets are supplied from the paper sheet supplying apparatus 300 in the first place. That is, paper sheets corresponding in number to the paper sheets stopped inside the image forming system 1 and removed as described above are supplied in the first place. At this time, images are formed on the supplied paper sheets in the image forming unit 110. Then, as shown in FIG. 7B, paper sheets on which images have already been formed are supplied from the interposer 240 so as to immediately follow the paper sheets supplied from the paper sheet supplying apparatus 300.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming system comprising:

a first transporting unit that transports paper sheets along a first transportation route;

an image forming unit that forms images on the paper sheets transported by the first transporting unit;

a sheet supplying unit that has a second transportation route, and transports a sheet along the second transportation route to supply the sheet to a gap between the paper sheets sequentially transported along the first transportation route, the second transportation route joining the first transportation route at a position located on a downstream of the image forming unit in a paper sheet transporting direction; and a controller that outputs, to a first output unit, a paper sheet located on a downstream of the gap between the paper sheets in the paper sheet transporting direction, when the sheet is not supplied from the sheet supplying unit to the gap between the paper sheets, and outputs, to a second output unit different from the first output unit, a paper sheet transported along the first transportation route and located on an upstream of the gap between the paper sheets in the paper sheet transporting direction while causing the image forming unit to form an image on the paper sheet transported along the first transportation route and located on an upstream of the image forming unit, when the sheet is not supplied from the sheet supplying unit to the gap between the paper sheets.

2. The image forming system according to claim 1, wherein, in any one of cases where a plurality of sheets are transported by the sheet supplying unit while being overlapped with each other, and where a failure in sheet transportation occurs in the sheet supplying unit, the controller outputs, to the first output unit, the paper sheet located on the downstream of the gap between the paper sheets in the paper sheet transporting direction, and outputs, to the second output unit, the paper sheet located on the upstream of the gap between the paper sheets in the paper sheet transporting direction.

3. The image forming system according to claim 1, wherein:

the sheet supplying unit further comprises:

a first sheet supplying unit on which the paper sheet outputted to the second output unit is allowed to be stacked; and a first feeding unit that feeds, into the second transportation route, the paper sheet stacked on the first sheet supplying unit, and the paper sheet outputted to the second output unit is allowed to be supplied to the first transportation route by being stacked on the first sheet supplying unit.

4. The image forming system according to claim 3, wherein:

the sheet supplying unit further comprises:

a second sheet supplying unit on which the sheet is stacked; and a second feeding unit that feeds, into the second transportation route, the sheet stacked on the second sheet supplying unit; and, the controller causes the first feeding unit to feed the paper sheet stacked on the first sheet supplying unit into the second transportation route, after causing the second feeding unit to feed the sheet stacked on the second sheet supplying unit into the second transportation route.

5. The image forming system according to claim 4, further comprising a paper sheet supplying unit that sequentially supplies the paper sheets to the first transportation route at a position located on the upstream of the image forming unit in the paper sheet transporting direction, and that stops supplying the paper sheets when the sheet is not supplied from the sheet supplying unit to the gap between the paper sheets, wherein the controller causes the paper sheet supplying unit to restart to supply the paper sheets so that the paper sheets supplied from the paper sheet supplying unit may follow, in the first transportation route, the paper sheet fed into the second transportation route.

6. The image forming system according to claim 1, further comprising a receiving unit that receives selection of a mode by a user, wherein, the controller causes the image forming unit to form an image on the paper sheet located on the upstream of the image forming unit in the paper sheet transporting direction when selection of one mode is received by the receiving unit, and then outputs the paper sheet, whereas the controller outputs the paper sheet located on the upstream of the image forming unit in the paper sheet transporting direction, without causing the image forming unit to form an image on the paper sheet located on the upstream of the image forming unit when selection of another mode is received by the receiving unit.

7. A paper sheet output method including: a first transporting unit that transports paper sheets along a first transportation route; an image forming unit that forms images on the paper sheets transported by the first transporting unit; and a sheet supplying unit that has a second transportation route, and transports a sheet along the second transportation route to supply the sheet to a gap between the paper sheets sequentially transported along the first transportation route, the second transportation route joining the first transportation route at a position located on a downstream of the image forming unit in a paper sheet transporting direction, the paper sheet output method comprising:

outputting, to a first output unit, a paper sheet located on a downstream of the gap between the paper sheets in the paper sheet transporting direction when the sheet is not supplied from the sheet supplying unit to the gap between the paper sheets; and outputting, to a second output unit different from the first output unit, a paper sheet located on an upstream of the gap between the paper sheets in the paper sheet transporting direction while causing the image forming unit to form an image on the paper sheet located on the upstream of the image forming unit, when the sheet is not supplied from the sheet supplying unit to the gap between the paper sheets.

8. An image forming system comprising:

a first transporting unit that transports paper sheets along a first transportation route;

an image forming unit that forms images on the paper sheets transported by the first transporting unit;

a sheet supplying unit that has a second transportation route, and transports a sheet along the second transportation route to supply the sheet to a gap between the paper sheets sequentially transported along the first transportation route, the second transportation route joining the first transportation route at a position located on a downstream of the image forming unit in a paper sheet transporting direction; and a controller that outputs, to a first output unit, a paper sheet located on a downstream of the gap between the paper sheets in the paper sheet transporting direction, when the sheet is not supplied from the sheet supplying unit to the gap between the paper sheets, and outputs, to a second output unit different from the first output unit, a paper sheet transported along the first transportation route and located on an upstream of the gap between the paper sheets in the paper sheet transporting direction while causing the image forming unit to form an image on the paper sheet transported along the first transportation route and located on an upstream of the image forming unit, when the sheet is not supplied from the sheet supplying unit to the gap between the paper sheets, and outputs, to the first output unit, a paper sheet located on a downstream of a sheet that supplied from the sheet supplying unit in the paper sheet transporting direction, when the sheet is supplied from the sheet supplying unit to the gap between the paper sheets.

* * * * *